US009037034B2

(12) United States Patent
Ikeda et al.

(10) Patent No.: US 9,037,034 B2
(45) Date of Patent: May 19, 2015

(54) IMAGE FORMING APPARATUS HAVING EXHAUST TREATMENT SYSTEM

(71) Applicants: Tomofumi Ikeda, Toyokawa (JP); Shoichi Yoshikawa, Okazaki (JP); Kuniya Matsuura, Toyohashi (JP); Masayuki Satou, Toyohashi (JP); Ryo Oshima, Anjo (JP); Noboru Oomoto, Toyokawa (JP)

(72) Inventors: Tomofumi Ikeda, Toyokawa (JP); Shoichi Yoshikawa, Okazaki (JP); Kuniya Matsuura, Toyohashi (JP); Masayuki Satou, Toyohashi (JP); Ryo Oshima, Anjo (JP); Noboru Oomoto, Toyokawa (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 115 days.

(21) Appl. No.: 13/771,111

(22) Filed: Feb. 20, 2013

(65) Prior Publication Data

US 2013/0243471 A1 Sep. 19, 2013

(30) Foreign Application Priority Data

Mar. 16, 2012 (JP) ..... 2012-059712

(51) Int. Cl.
*G03G 21/20* (2006.01)

(52) U.S. Cl.
CPC ..... *G03G 21/206* (2013.01)

(58) Field of Classification Search
USPC ..... 399/92, 93
See application file for complete search history.

(56) References Cited

U.S. PATENT DOCUMENTS 5,028,959 A * 7/1991 Gooray ..... 399/93
5,307,132 A * 4/1994 Tsuchiya ..... 399/70
5,749,039 A * 5/1998 Thomas ..... 399/397
6,094,549 A * 7/2000 Hiraoka et al. ..... 399/93
2005/0271414 A1 12/2005 Katayama et al.
2006/0275048 A1* 12/2006 Nishimura et al. ..... 399/92
2008/0217556 A1 9/2008 Kagawa et al.
2011/0211860 A1* 9/2011 Shimoyama et al. ..... 399/93
2012/0014707 A1* 1/2012 Eden et al. ..... 399/92

FOREIGN PATENT DOCUMENTS

JP 61-200556 A 9/1986
JP 2006-18240 A 1/2006
JP 2007-47496 A 2/2007
JP 2008-52065 A 3/2008
JP 2008-251514 A 10/2008
JP 2011-128467 A 6/2011
JP 2011-141447 A 7/2011

OTHER PUBLICATIONS

Office Action (Notice of Reason for Refusal) issued on Feb. 18, 2014, by the Japanese Patent Office in corresponding Japanese Patent Application No. 2012-059712, and an English Translation of the Office Action. (6 pages).

* cited by examiner

*Primary Examiner* — G. M. Hyder
(74) *Attorney, Agent, or Firm* — Buchanan Ingersoll & Rooney PC

(57) ABSTRACT

An image forming apparatus having; a fusing unit that heats and presses a recording medium with an image transferred thereto, thereby fixing the image thereon; a first duct section in which air that contains emissions generated by the fusing unit flows; an ion generation unit provided away from the first duct section to generate ions; a second duct section in which air that contains the ions generated by the ion generation unit flows; a third duct section connected to the first and second duct sections, such that air flows in from the first and second duct sections, whereby the emissions are charged by the ions; a filter unit provided in the third duct section to trap the charged emissions; and a blowing unit that generates air flows from the connections with the first and second duct sections in the third duct section toward the filter unit.

5 Claims, 4 Drawing Sheets

IMAGE FORMING APPARATUS HAVING EXHAUST TREATMENT SYSTEM

This application is based on Japanese Patent Application No. 2012-059712 filed on Mar. 16, 2012, the content of which is incorporated herein by reference.

BACKGROUND OF THE INVENTION

1. Field of the Invention

The present invention relates to an image forming apparatus in which emissions from a fusing unit are trapped.

2. Description of Related Art

A conventional image forming apparatus as mentioned above is described in, for example, Japanese Patent Laid-Open Publication No. 2008-251514. This image forming apparatus has a duct provided above a fusing unit inside a frame. The duct includes a main section, which is a bottomless cover disposed directly above the fusing unit, and a hollow cylindrical section extending from the main section. The cylindrical section is connected to an exhaust vent provided in the frame, and has an air duct portion inside of it.

The cylindrical section has an exhaust fan provided inside at the exhaust vent-side end. Moreover, a dust removal filter is provided at the opposite (main section-side) end to the exhaust vent, so as to cover the air duct portion. The exhaust fan rotates so as to feed air inside the cylindrical section from the main section side to the exhaust vent side. As a result, air heated by the fusing unit is collected into the main section, and passes through the cylindrical section to be ejected from the exhaust vent to the outside of the frame.

Furthermore, the fusing unit emits substances such as odorants, volatile organic compounds (referred to below as VOCs), low-molecular siloxane, and dust (e.g., toner and paper dust). Among these emissions, for example, particles of VOCs, odorants, and low-molecular siloxane are so fine that they can pass through the filter. To remove such fine particles, the image forming apparatus is provided with an ion generator that generates negative ions. Specifically, the ion generator is provided upstream of the exhaust fan in a direction in which air is fed and downstream of the filter in that air feeding direction. The ion generator generates negative ions inside the duct, so that VOCs, etc., can be neutralized by action of the negative ions, thereby reducing VOCs, etc., contained in exhaust gas.

As is apparent from the foregoing, the negative ion generator is exposed to VOC particles, etc., so that the particles adhere thereto. This results in a reduction in the amount of ion generation by the negative ion generator.

SUMMARY OF THE INVENTION

An image forming apparatus according to an embodiment of the present invention includes: a fusing unit that heats and presses a recording medium with an image transferred thereto, thereby fixing the image on the recording medium; a first duct section in which air that contains emissions generated by the fusing unit flows; an ion generation unit provided away from the first duct section to generate ions; a second duct section in which air that contains the ions generated by the ion generation unit flows; a third duct section connected to the first duct section and the second duct section, such that air flows in from the first duct section and the second duct section, whereby the emissions are charged by the ions; a filter unit provided in the third duct section to trap the charged emissions; and a blowing unit that generates flows of air from the connections with the first and second duct sections in the third duct section toward the filter unit.

DETAILED DESCRIPTION OF THE PREFERRED EMBODIMENTS

Figure 1:
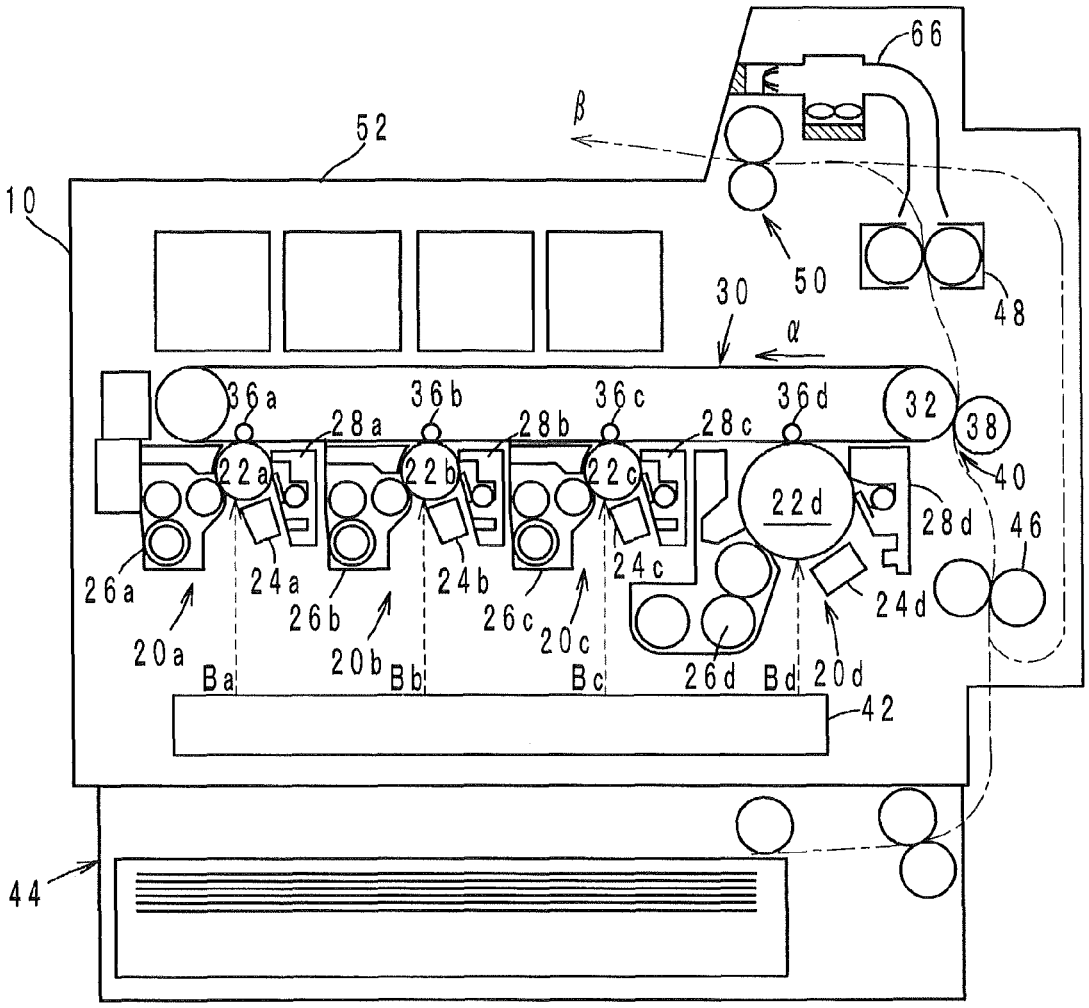
FIG. 1 is a vertical cross section illustrating the internal configuration of an image forming apparatus according to an embodiment of the present invention.
Figure 1:
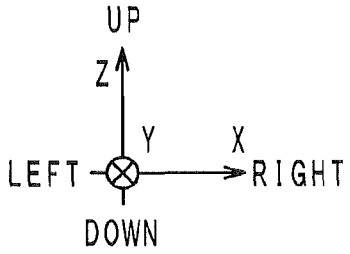

Hereinafter, an image forming apparatus according to an embodiment of the present invention will be described with reference to the drawings. In some figures, arrows X, Y, and Z are shown. Arrows X, Y, and Z indicate the right, rear (depth direction), and top sides, respectively, of the image forming apparatus. The lower-case alphabet letters a, b, c, and d suffixed to reference numerals are affixes that denote yellow (Y), magenta (M), cyan (C), and black (Bk). For example, a photoreceptor drum 22*a* is intended to mean a photoreceptor drum 22 for yellow.

General Configuration of Image Forming Apparatus

In FIG. 1, the image forming apparatus is an electrographic multifunction peripheral (MFP), color printer, copier, duplicator, or the like, which is a typical example of equipment in which an exhaust system is provided. For example, the image forming apparatus forms a full-color image using a tandem system, and prints the image on a recording medium such as a sheet of paper. To this end, the image forming apparatus generally includes processing units 20*a* to 20*d*, an optical laser scanning system 42, an intermediate transfer belt 30, and a fusing unit 48, all of which are provided in a main unit 10.

The processing units 20*a* to 20*d* are arranged side-by-side from left to right in the image forming apparatus, and include photoreceptor drums 22*a* to 22*d*, which are typical examples of image supports. The photoreceptor drums 22*a* to 22*d* extend in the depth direction of the image forming apparatus, and rotate by means of drive forces from unillustrated motors. Moreover, provided around the photoreceptor drums 22*a* to 22*d* are, from upstream to downstream in their rotational directions, charging units 24*a* to 24*d*, developing units 26*a* to 26*d*, cleaning units 28*a* to 28*d*, etc.

The optical laser scanning system 42 is provided below the processing units 20*a* to 20*d*, and receives image data for the colors Y, M, C, and K from, for example, a personal computer. The optical laser scanning system 42 emits optical beams Ba to Bd, which are modulated with the received image data, to the photoreceptor drums 22*a* to 22*d*.

The intermediate transfer belt 30 is rotationally driven in a counterclockwise loop, as indicated by arrow a, when viewed from the front side of the image forming apparatus. Moreover, primary transfer rollers 36*a* to 36*d* are provided so as to be opposed to the photoreceptor drums 22*a* to 22*d* with respect to the intermediate transfer belt 30. In addition, a secondary transfer roller 38 is disposed so as to be opposed to the roller 32 with respect to the intermediate transfer belt 30 and tightly contact the intermediate transfer belt 30. A secondary transfer area 40 is created by the secondary transfer roller 38 and the intermediate transfer belt 30.

A supply device 44 is provided below the main unit 10. The supply device 44 takes up one-by-one sheets of paper placed therein, and forwards them to a feeding path indicated by long dashed short dashed arrow β (referred to below as a feeding path β)

Provided in the feeding path β are, from upstream to downstream, a timing roller pair 46, the secondary transfer area 40, the fusing unit 48, an ejection/reverse roller 50, and an output tray 52.

General Operation of Image Forming Apparatus

Next, the general operation of the image forming apparatus will be described. In the image forming apparatus, the charging units 24*a* to 24*d* charge the circumferential surfaces of the rotating photoreceptor drums 22*a* to 22*d*. The optical laser scanning system 42 irradiates the charged circumferential surfaces of the photoreceptor drums 22*a* to 22*d* with optical beams Ba to Bd (i.e., exposure), thereby forming electrostatic latent images of the colors Y, M, C, and K. The developing units 26*a* to 26*d* supply toner to the photoreceptor drums 22*a* to 22*d* with the electrostatic latent images supported thereon (i.e., development), thereby forming toner images of the colors Y, M, C, and K. Due to voltage being applied to the primary transfer rollers 36*a* to 36*d*, the toner images on the photoreceptor drums 22*a* to 22*d* are electrostatically transferred in a sequential manner onto the same area of the intermediate transfer belt 30 (i.e., primary transfer). As a result, a full-color composite toner image is formed on the intermediate transfer belt 30. The composite toner image is fed to the secondary transfer area 40 while being supported on the intermediate transfer belt 30.

Any toner (untransferred toner) that is not subjected to primary transfer remains on the circumferential surfaces of the photoreceptor drums 22*a* to 22*d*. Such untransferred toner is scraped off by the cleaning units 28*a* to 28*d*, and collected in an unillustrated waste toner box (i.e., cleaning).

Furthermore, a sheet of paper forwarded from the supply device 44 travels in the feeding path β and contacts the timing roller pair 46 at rest without rotation. Thereafter, the timing roller pair 46 starts rotating in synchronization with transfer timing in the secondary transfer area 40, thereby feeding the sheet at temporary rest to the secondary transfer area 40.

In the secondary transfer area 40, the composite toner image on the intermediate transfer belt 30 is transferred to the sheet fed by the timing roller pair 46 (i.e., secondary transfer). The sheet subjected to secondary transfer is fed further downstream of the feeding path β by the secondary transfer roller 38 and the intermediate transfer belt 30.

The fusing unit 48 includes a heat roller and a pressure roller, which extend in the front-rear direction of the fusing unit. The sheet fed from the secondary transfer area 40 is introduced between these rollers. The heat roller heats the toner on the sheet passing through the heat roller and the pressure roller, and simultaneously, the pressure roller presses the sheet (i.e., fusing process). Thereafter, the rollers forward the sheet subjected to the fusing process, further downstream of the feeding path β. The forwarded sheet is ejected onto the output tray 52.

Regarding Trap System

Figure 2:
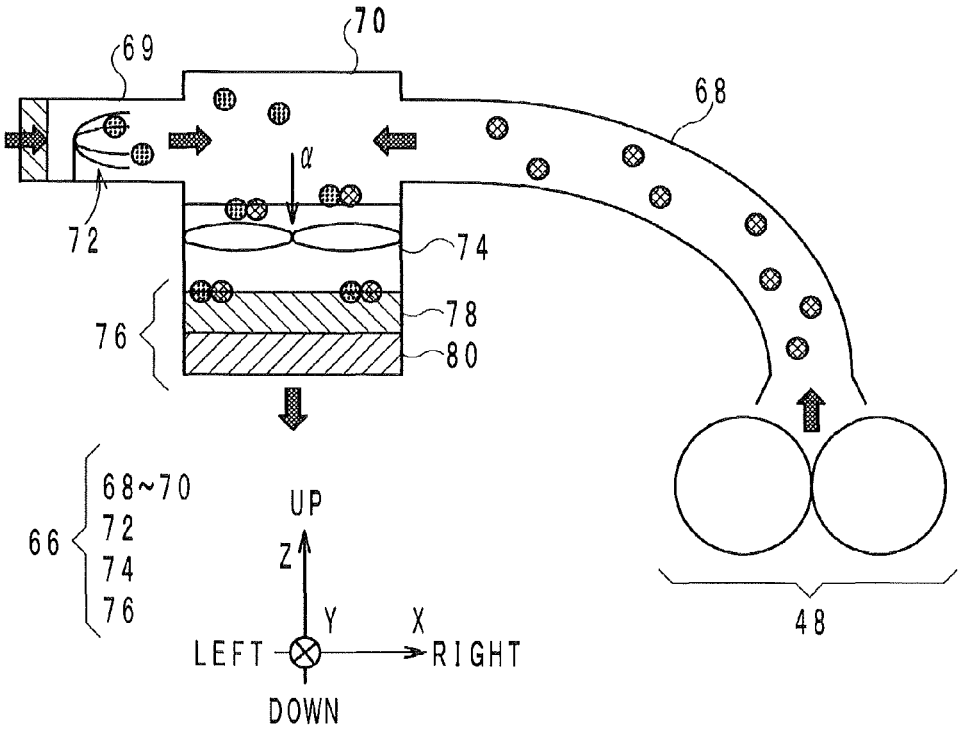
FIG. 2 is a schematic diagram illustrating in vertical cross section a trap system in FIG. 1.

As has already been described, the fusing unit 48 emits substances such as odorants, VOCs, low-molecular siloxane, and dust (e.g., toner and paper dust). To trap such emissions, a trap system 66 as shown in FIG. 1 is provided. In an example of the present embodiment, the trap system 66 is provided above the fusing unit 48 and fixed to the main unit 10. The trap system 66 includes first, second, and third duct sections 68, 69, and 70, an ion generator 72, a blowing unit 74, and a filter unit 76, as shown in FIG. 2.

The first to third duct sections 68 to 70 are made of a resin or metal material that has heat resistance to the temperature of the fusing unit 48.

The first duct section 68 has branches that extend upward from their upstream ends, for example, directly above the front and rear ends of the fusing unit 48 and bend leftward to be merged together. Note that for convenience's sake, the branch of the first duct section 68 that extends from the rear end of the fusing unit 48 is not shown in the figure. The first duct section 68 further extends from the merging point toward the third duct section 70 (to be described later) and is connected at its downstream end to the third duct section 70. In addition, the first duct section 68 has openings at the upstream ends, which are approximately parallel to the horizontal plane, and further, the first duct section 68 is hollow from the upstream ends to the downstream end.

The second duct section 69 is hollow from the upstream end to the downstream end. The second duct section 69 is disposed so as to have the upstream end opposed to, for example, an intake vent provided in the main unit 10, and extends rightward from the upstream end. The second duct section 69 is connected at the downstream end to the third duct section 70 (to be described later).

The ion generator 72 is provided between the upstream and downstream ends of the second duct section 69. The ion generator 72 has an electrode to which a high voltage is applied to create a flow of ions in the air (i.e., electric discharge). The ions charge emissions generated by the fusing unit 48.

The third duct section 70 has a vertically extending cylindrical shape, and is hollow inside. In the example of the present embodiment, the third duct section 70 is closed at the top and is open at the bottom. Moreover, the third duct section 70 is connected to the first duct section 68 and the second duct section 69 near the top end.

The third duct section 70 has the blowing unit 74 provided so as to block the hollow on the downstream side from the connections with the first duct section 68 and the second duct section 69 (in the illustrated example, the blowing unit 74 is provided below the connections). The blowing unit 74 is typically a blast fan whose rotary blades rotate about a shaft a, thereby taking in air from upstream (above) and blowing out air to downstream (downward).

Furthermore, the filter unit 76 at least includes an electrostatic filter 78. The electrostatic filter 78 is disposed so as to contact the downstream side of the blowing unit 74. Moreover, the electrostatic filter 78 is charged with a polarity opposite to the charge polarity of emissions. In addition, preferably, the filter unit 76 further includes an ozone filter 80. The ozone filter 80 contains, for example, activated carbon, and is disposed so as to contact the downstream side of the electrostatic filter 78.

Regarding Air Flow

Once the image forming apparatus starts a printing process, power is supplied to the blowing unit 74 and the ion generator 72 in the trap system 66 configured as above. Moreover, the electrostatic filter 78 is charged.

Once the rotary blades of the blowing unit 74 start rotating, air flow is generated from the connections with the first duct section 68 and the second duct section 69 in the third duct section 70 toward the filter unit 76 (in the present embodiment, downward from above). This air flow causes air around the front and rear ends of the fusing unit 48 to mainly enter the upstream end of the first duct section 68 and move toward the downstream end. The air flow carries emissions from the fusing unit 48. Moreover, ions generated by the ion generator 72 are carried through the second duct section 69 toward the downstream end. Note that in FIG. 2, emissions are indicated by circles with grid-like hatching, and ions are indicated by circles with dots.

The emissions and the ions enter the third duct section 70 from the connections with the first and second duct sections 68 and 69, so that the emissions are charged by the ions. The charged emissions are carried by air flow to the bottom of the third duct section 70, and enter the electrostatic filter 78, which is charged with a polarity opposite to the charge polarity of the emissions, via the blowing unit 74. The electrostatic filter 78 lets air pass through while trapping the emissions. The ozone filter 80 lets the air from the electrostatic filter 78 pass through while adsorbing ozone contained in the air.

Actions and Effects of Trap System

As described above, in the trap system 66, the air flow generated by the blowing unit 74 draws air toward the filter unit 76 from where the third duct section 70 is merged with the first and second duct sections 68 and 69. Accordingly, emissions having entered the third duct section 70 from the first duct section 68 are not carried toward the second duct section 69 but toward the filter unit 76. As a result, the emissions can be prevented from intruding into the second duct section 69, and therefore can be prevented from adhering to the ion generator 72. Thus, reduction in the amount of ion generation can be prevented.

First Modification

Figure 3:
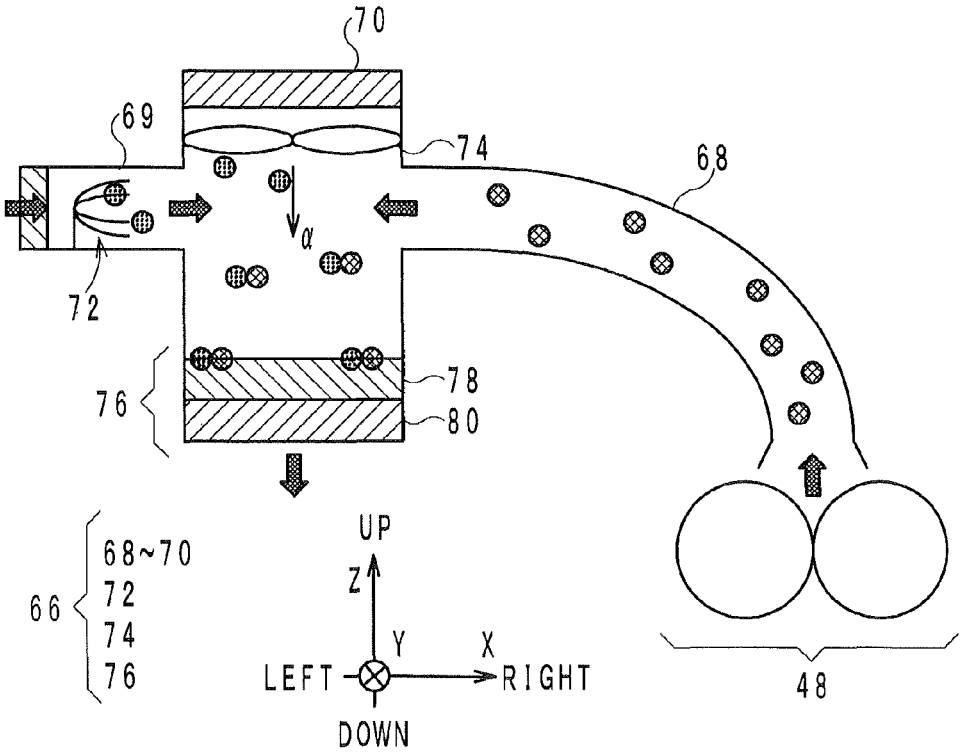
FIG. 3 is a schematic diagram illustrating in vertical cross section a first modification of the trap system in FIG. 1.

Note that in the above embodiment, the blowing unit 74 is provided below the merging portions, but this is not restrictive, and the blowing unit 74 may be provided thereabove, as shown in FIG. 3. In such a case, the third duct section 70 is not closed at the top. This configuration also achieves the same effects as described above.

Second Modification

Figure 4:
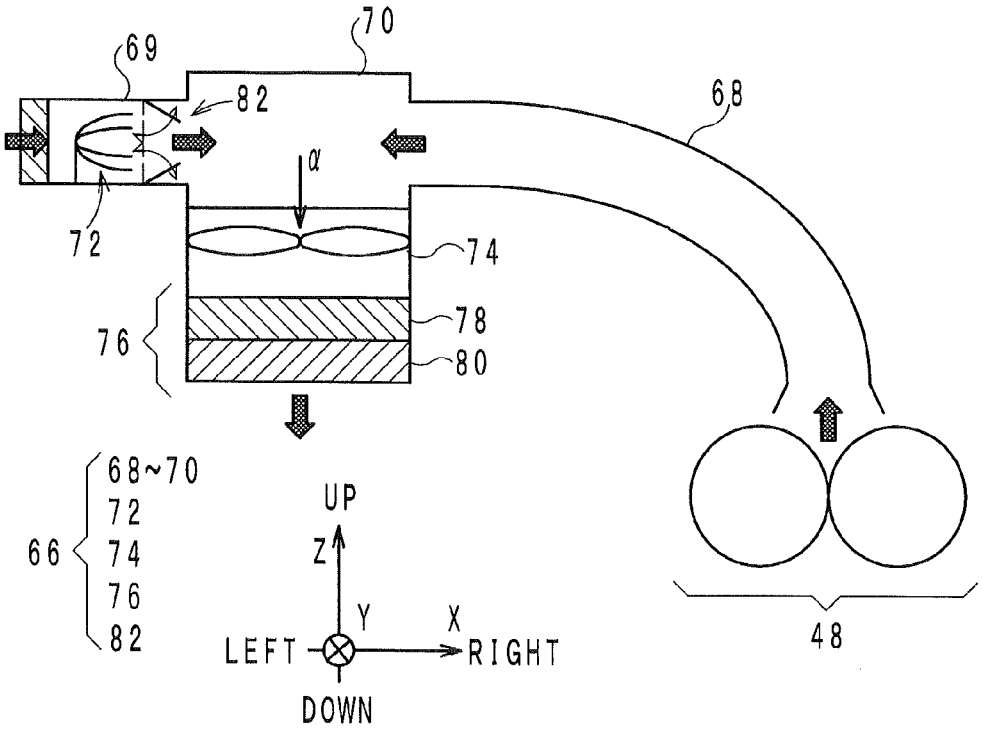
FIG. 4 is a schematic diagram illustrating in vertical cross section a second modification of the trap system in FIG. 1.

Furthermore, as shown in FIG. 4, the second duct section 69 preferably includes a valve 82 disposed downstream from the ion generator 72, which is caused to open and close through natural convection when the blowing unit 74 is supplied with power. Thus, emissions can be more successfully prevented from intruding into the second duct section 69.

Third Modification

Figure 5:
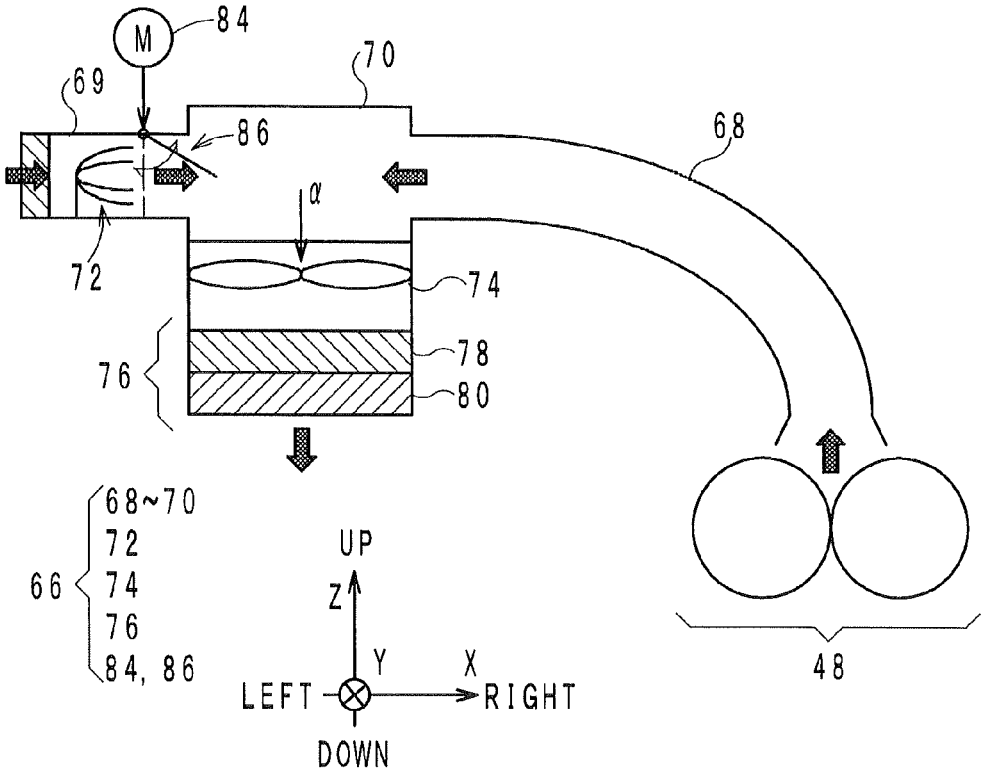
FIG. 5 is a schematic diagram illustrating in vertical cross section a third modification of the trap system in FIG. 1.

Furthermore, as shown in FIG. 5, the second duct section 69 preferably includes a shutter 86 disposed downstream from the ion generator 72, which is caused to open and close by means of a drive force from a motor 84 when the blowing unit 74 is supplied with power. This also successfully prevents emissions from intruding into the second duct section 69.

Fourth Modification

Figure 6:
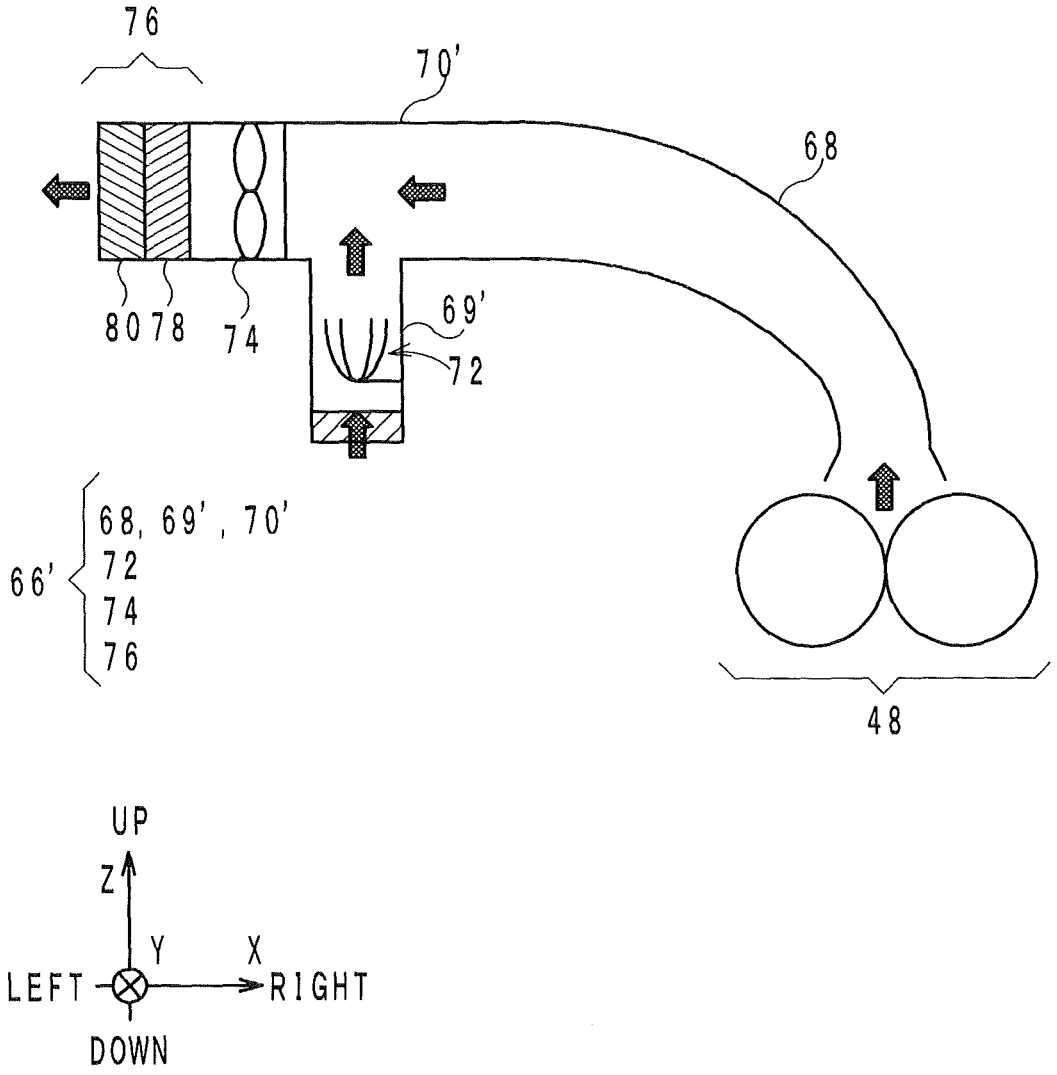
FIG. 6 is a schematic diagram illustrating in vertical cross section a fourth modification of the trap system in FIG. 1.

Next, referring to FIG. 6, a trap system 66' according to a fourth modification will be described. The trap system 66' of FIG. 6 includes second and third duct sections 69' and 70' in place of the second and third duct sections 69 and 70. There is no other difference between the trap systems 66 and 66', therefore, in FIG. 6, features corresponding to those in FIG. 2 are denoted by the same reference numerals, and any descriptions thereof will be omitted.

The second and third duct sections 69' and 70' are made of, for example, a similar resin material to the second and third duct sections 69 and 70.

The second duct section 69' is hollow from top to bottom, and is connected at the top to the third duct section 70' (to be described later). The ion generator 72 as described above is disposed between the bottom (upstream end) of the second duct section 69' and the top (downstream end).

The third duct section 70' has a cylindrical shape extending in the right-left direction, and is hollow inside. In the example of the present embodiment, the first duct section 68 is connected to the right end of the third duct section 70', and the second duct section 69' is connected to the bottom of the third duct section 70' near the left end thereof.

On the downstream side (in the illustrated example, left side) in the third duct section 70' relative to the connections with the first duct section 68 and the second duct section 69', the blowing unit 74, the electrostatic filter 78, and the ozone filter 80 are arranged in this order from upstream to downstream, as in the above embodiment.

The temperature of the fusing unit 48 rises high during operation, so that the temperature of air flowing from the first duct section 68 into the third duct section 70' is higher than the temperature of air flowing from the second duct section 69'. Accordingly, the air from the first duct section 68 flows in the upper portion of the third duct section 70'. In the third duct section 70', negative pressure is applied through chimney effect so that the air from the second duct section 69' flows under the layer of air from the first duct section 68. As a result, in the fourth modification also, emissions can be prevented from intruding into the second duct section 69'. Thus, reduction in the amount of ion generation can be prevented.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

a fusing unit that heats and presses a recording medium with an image transferred thereto, thereby fixing the image on the recording medium;

a first duct section in which air that contains emissions generated by the fusing unit flows;

an ion generation unit provided away from the first duct section to generate ions;

a second duct section in which air that contains the ions generated by the ion generation unit flows;

a third duct section connected to the first duct section and the second duct section, such that air flows in from the first duct section and the second duct section, whereby the emissions are charged by the ions;

a filter unit provided in the third duct section to trap the charged emissions;

a blowing unit that generates flows of air from the connections with the first and second duct sections in the third duct section toward the filter unit; and an opening/closing mechanism capable of opening and closing the second duct section, wherein the opening/closing mechanism closes the second duct section after the blowing unit stops generating the flows of air.

2. The image forming apparatus according to claim 1, wherein the opening/closing mechanism is a valve that is caused to open and close through natural convection.

3. The image forming apparatus according to claim 1, wherein, the opening/closing mechanism is a shutter that is caused to open and close by means of a drive force applied thereto, and the image forming apparatus further comprises a motor that generates a drive force to close the shutter after the blowing unit stops generating the flows of air.

4. The image forming apparatus according to claim 1, wherein the second duct section is connected below the first duct section and the third duct section.

5. The image forming apparatus according to claim 1, wherein the filter unit includes an electrostatic filter.

* * * * *